US012759683B2

(12) United States Patent
Liljeback

(10) Patent No.: US 12,759,683 B2
(45) Date of Patent: Oct. 13, 2026

(54) UNDERWATER SNAKE ROBOT WITH PASSIVE JOINTS

(71) Applicant: EELUME AS, Trondheim (NO)

(72) Inventor: Pål Liljeback, Vikhammer (NO)

(73) Assignee: EELUME AS, Trondheim (NO)

( * ) Notice: Subject to any disclaimer, the term of this patent is extended or adjusted under 35 U.S.C. 154(b) by 593 days.

(21) Appl. No.: 18/245,826

(22) PCT Filed: Sep. 17, 2021

(86) PCT No.: PCT/EP2021/075715

§ 371 (c)(1),
(2) Date: Mar. 17, 2023

(87) PCT Pub. No.: WO2022/058560

PCT Pub. Date: Mar. 24, 2022

(65) Prior Publication Data

US 2024/0025523 A1 Jan. 25, 2024

(30) Foreign Application Priority Data

Sep. 18, 2020 (GB) ..... 2014738

(51) Int. Cl.
*B63G 8/08* (2006.01)
*B63G 8/00* (2006.01)

(52) U.S. Cl.
CPC ..... *B63G 8/001* (2013.01); *B63G 8/08* (2013.01); *B63G 2008/004* (2013.01); *B63G 2008/005* (2013.01)

(58) Field of Classification Search
CPC . B63G 8/00; B63G 8/001; B63G 8/08; B63G 8/14
USPC ..... 114/312, 330, 337
See application file for complete search history.

(56) References Cited

U.S. PATENT DOCUMENTS

| | | | |
|---|---|---|---|
| 3,903,825 | A | 9/1975 | Hamy |
| 6,973,893 | B2 | 12/2005 | Holmes |
| 10,751,872 | B2 | 8/2020 | Petterson et al. |
| 2009/0248202 | A1 | 10/2009 | Osuka et al. |

FOREIGN PATENT DOCUMENTS

| | | | |
|---|---|---|---|
| GB | 2405125 | A | 2/2005 |
| WO | WO 2016/055408 | A1 | 4/2016 |
| WO | WO 2016/120071 | A1 | 8/2016 |

OTHER PUBLICATIONS

Search Report from the Intellectual Property Office of United Kingdom Application No. GB2014738.5, mailed on Mar. 18, 2021, 4 pages.
International Search Report and Written Opinion of International Application No. PCT/EP2021/075715, mailed on Jan. 18, 2022, 10 pages.
International Search Report and Written Opinion of International Application No. PCT/US2021/075715, mailed on Jan. 18, 2022, 10 pages.

*Primary Examiner* — Lars A Olson
(74) *Attorney, Agent, or Firm* — Heslin Rothenberg Farley & Mesiti P.C.; George S. Blasiak, Esq.

(57) ABSTRACT

An underwater snake robot 200 for performing subsea operations, the robot 200 comprising: a series of links 202, 204 that are connected to one another by one or more passive joint modules 201 for allowing a flexural motion of the robot 200; and multiple thrust devices 203 for applying thrust to the robot 200 for propulsion, for generating the flexural motion of the robot and for controlling the orientation and location of the links 202, 204.

20 Claims, 5 Drawing Sheets

UNDERWATER SNAKE ROBOT WITH PASSIVE JOINTS

CROSS REFERENCE TO RELATED APPLICATIONS

Figure 1A:
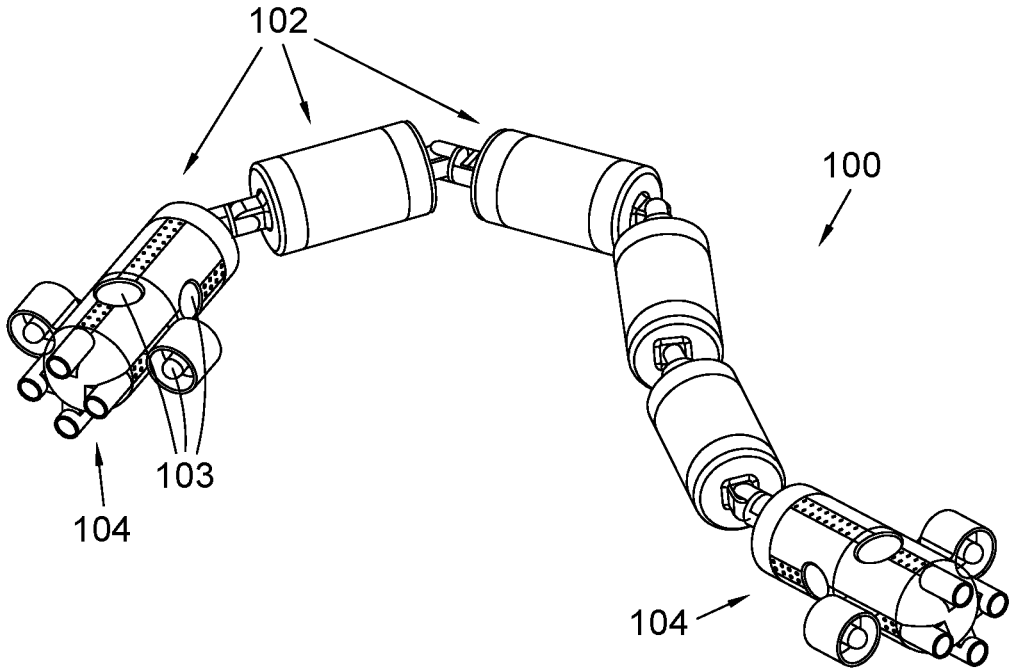

This application is a national stage filing under section 371 of International Application No. PCT/EP2021/075715 filed on Sep. 17, 2021, and published on Mar. 24, 2022, as WO2022/058560 A1 and claims priority to United Kingdom Application No. 2014738.5 filed on Sep. 18, 2020. The entire contents of WO2022/058560 A1 are hereby incorporated herein by reference.

The present invention relates to underwater snake robots for performing subsea operations, in particular the example embodiments include an underwater snake robot comprising passive joint modules, an underwater snake robot with a large length to diameter ratio, and a system and method for storing, launching and/or recovering an underwater snake robot.

Submersible robots are used for various purposes in the prior art. Autonomous and remote controlled robots can take many forms and sizes and have been adapted for numerous purposes. Some known designs, such as those described in WO 2016/120071 include so-called 'snake robots', which move with an eel-like or fish-like motion using active motorized joints to propel the robot through the water via driven movement of the joints. In this way, a flexural motion of the robot can be generated that is an undulating motion capable of propelling the robot by pushing against the surrounding fluid with the body. Active/motorized body articulation devices (i.e. active motorized joints) for such underwater vehicles are typically complex and expensive and may also be prone to failure or require regular maintenance due to their complexity.

Other known designs include gliders using buoyancy driven propulsion for mapping and monitoring, ROVs (remotely operated vehicles) and AUVs (autonomous underwater vehicles) with manipulators for physical interaction with other objects, such as robotic arms holding grasping mechanisms and other tools. The ROV or AUV must provide a stable base in order to support the arm, and hence such vehicles are relatively large and cumbersome. Gliders are limited in accuracy when it comes to guidance, navigation and control, and only able to work effectively as they undulate downwards or upwards. This makes it difficult to use underwater manipulator robots when it is required to manipulate an object in a small space, or when the access to the working area is narrow.

Many of the above described submersible robots are also limited in their range and operational abilities due to restrictions on available power. These limitations are primarily placed on the robots due to their size, which is itself limited in order to ensure the robots remain mobile/agile in water. With reduced size, less space is available for batteries and the like. As a result, these robots must be regularly recharged, which requires the interruption of operations.

According to a first aspect, the present invention provides an underwater snake robot for performing subsea operations, the robot comprising: a series of links that are connected to one another by one or more passive joint modules for allowing a flexural motion of the robot; and one or more thrust devices for applying thrust to the robot for propulsion, for generating the flexural motion of the robot and for controlling the orientation and location of the links.

By utilising passive joint modules, rather than active joint modules such as those described in WO 2016/120071, and generating the flexural motion of the robot/controlling the orientation and location of the links instead with the thrust device(s) the complexity of the robot is reduced. This reduced complexity in turn reduces the chances of failure of the joint modules and reduces the amount of maintenance required.

The arrangement of the above first aspect is therefore simple and robust; cheaper to produce and maintain compared to active joint systems; and lighter in weight (and thus easier to lift and handle) compared to heavier, active motorized systems. The arrangement of the first aspect also allows for simplified transport, launch and recovery of the robot, as discussed in more detail below.

The robot may comprise multiple thrust devices. Such multiple thrust devices may be positioned along the length of the robot for generating the flexural motion of the robot and/or controlling the orientation and location of the links.

The robot of the first aspect does not swim via active motion of the joints as with the robot of WO 2016/120071, but still has the same degree of flexibility and can move into the same positions and orientations by use of the thrust device(s). For moving longer distances it may be propelled forward with all the joint modules aligned to form the robot into a straight elongate configuration.

By the reference to a robot for performing subsea operations, it is meant that the robot is suitable for at least one particular subsea operation. For example, the robot may include the necessary equipment for performing a particular subsea operation, such as via one or more accessories provided on the robot. For example, for the purposes of inspecting subsea pipelines, the robot may include one or more cameras and light sources. Additionally, or alternatively, the robot may include manipulator tools such as a gripper tool. The possibilities of various accessories are discussed in more detail below.

In the current context a snake robot is any type of multi-linked robot designed to flex at two or more joints, typically at a large number of joints. Such robots may alternatively be designated as eel robots or lamprey robots in the art and the term "snake robot" is intended to cover this.

The underwater snake robot should also be distinguished from ground based snake robots. Ground based snake robots are considerably different since they rely on friction between the robot and the ground, often using free-rolling wheels to prevent sideways slipping in order to move the robot with an undulating motion with active joints, or driven wheels or "feet" to provide other forms of movement. In contrast, underwater robots do not rely on interaction with a solid surface using friction and instead are propelled by interaction with the water. In the present case, the one or more thrust devices provide propulsive forces and they may be the sole source of propulsion for the underwater snake robot.

In preferred examples the robot comprises at least three, four or five links joined by passive joint modules allowing for articulated motion, which can be driven by the thrust device(s). The links can take any suitable form, and in particular they may be thrust modules (e.g. links provided with one or more thrust devices), battery modules, rigid links with guide fins, or rigid coupling links with no thrust or guidance function (all discussed in more detail below). As such, the term link is intended to cover typically rigid components positioned and connected in between the joint modules. There may be at least three links, at least five links, at least ten links, or at least twenty links for example. The snake robot may have similar numbers of joint modules, each joint providing one or more degrees of freedom.

By passive joint modules it is meant that the joint modules only respond to external forces to change their shape and/or angle of flexion. The passive joint modules of the example embodiment do not have the ability to control their own shape and/or angle. The shape and/or angle of flexion of the joint modules may be controllably altered under the influence of thrust from the thrust device(s). In this way, the passive joints do not generate any appreciable motive force themselves, although they may optionally generate frictional forces and/or some slight resistance to movement, such as to provide damping. The passive joints may therefore have no motors, and there may therefore be no direct control of their shape and/or angle of flexion, instead this is dictated by the overall dynamics of the system and primarily influenced by the thrust from the thrust device(s), although there may be other factors, such as currents in the water and buoyancy.

The body shape of the robot may therefore be controlled by the actions of one or more thrust devices, optionally multiple thrust devices located at different points along the length of the robot, and optionally is actively controlled solely by the thrust device(s). The motion of passive joint modules that do not directly receive forces from an associated thrust device may be analogous to a lorry truck or land train with multiple carriages, where the carriages passively follow the steering of the truck in the front.

The links of the robot and the passive joint modules that join the links together may share some components. For example, the joint module may comprise a connection and two end pieces or end caps, the end pieces being adjoined to, and optionally part of adjacent links. The links make be integrated with respective parts of the joint modules.

The one or more thrust devices apply thrust to the robot and may be arranged for propulsion of the entire robot in translation. Thus, as discussed below, one or more thrust devices may be for generating a propulsive force in a direction along the length of the robot, e.g. aligned with a longitudinal axis of the robot when all of the links are aligned in a straight elongate formation. The one or more thrust devices apply thrust to the robot to control the flexural motion of the entire robot, and may be arranged to apply a propulsive force in a direction at an angle to the length of the robot, i.e. in a lateral direction compared to the length of the robot and/or compared to the length of the link(s) to which the thrust device is attached. Alternatively or additionally the thrust device(s) may be arranged to apply a moment to a link of the robot in order to rotate that link and hence generate a flexural motion via the passive joint modules. In this way the thrust device(s), which may be as further discussed below, can control the orientation and location of all of the links by driving suitable movement of the passive joint modules.

All of the joint modules of the robot may be passive so that the robot includes no active joints. In that case the thrust device(s) may be the sole means for active control of the relative position and orientation of the links.

The passive joint modules may comprise any combination of the passive joint modules described herein, each including any or all of the optional features described.

The passive joint modules may permit relative rotation of adjacent links in a single plane to provide a two dimensional movement. Alternatively the joints may permit a higher dimensional movement, for example allowing for relative rotation both horizontally and vertically. The joint modules each permit relative rotation in one or more of the yaw, pitch and roll directions of the robot, optionally rotation in two of or all three of yaw, pitch and roll.

The passive joint modules may each comprise a flexural coupling with at least two degrees of freedom between adjacent links. For example, such a coupling may enable yawing and pitching between adjacent links of the robot.

The passive joint modules may each comprise a flexural coupling with at least three degrees of freedom between adjacent links. For example, such a coupling may additionally enable rolling between adjacent links of the robot.

The passive joint modules may each be couplings between adjacent links without any fixed pivot point. For example, the joint modules may comprise flexible cable couplings, such as durable subsea cables. These may allow for some further limited degrees of freedom, for example by allowing some translation between adjacent links (the extend of translation possibly being limited by the length and flexibility of the couplings) in addition to the yawing, pitch and roll described above.

The passive joint modules may each comprise a connector interface at each end which connects to adjacent links of the robot. This may allow for individual links and/or joint modules of the robot to be replaced when necessary. For example, battery modules (discussed in more detail below) may be replaced when more power is required by the robot. Additionally or alternatively, links and/or joint modules may be replaced when required for maintenance or repair.

The robot may comprise at least one battery module for supplying power to the robot. The battery module(s) may form links of the robot. Alternatively these may be combined with joint modules and/or one or more thrust devices. Battery modules may be located along the length of the robot, and these may be interspersed between joint modules and/or one or more thrust devices/modules (which may form other links as previously discussed).

The robot, links and/or passive joint modules may be modular. In this way the length and configuration of the robot may be adapted for a particular purpose, e.g. the number of links with battery modules may be increased to accommodate greater power requirements.

In such a case, entire links may be removed/replaced in a matter of seconds, such as for quick replacement of a depleted battery or for switching over between different accessories. For conventional rigid underwater vehicles, on the other hand, battery replacement typically requires that the vehicle is opened up in some way. For example, in the case of the passive joint module comprising a cable, the ends of the cable may include a connector interface which allows connected sections of the robot to be removed/replaced by simply disconnecting the connector.

Such arrangements also allow the robot to be split into segments for easier storage and/or transport. Furthermore, each segment may be lifted manually, and so the entire robot can be manually launched into the water by lifting each section in turn by its coupling cable and lowering it into the water. Similarly, the robot can be manually recovered. The launch/recovery process may therefore be simplified since the process may be split into several smaller lifting operations (one per vehicle segment) instead of handling an entire stiff/rigid vehicle.

The passive joint modules may each comprise more than one cable. For example, they may comprise at least two cables, one may be for high-current power and one for communication. The passive joint modules may comprise three or more cables. These multiple cables may be contained within a single protective sheath.

The passive joint modules may comprise a signal bus for enabling power transfer and/or communication between links. The signal bus may comprise electrical connections that are electrically coupled or uncoupled when the passive joint modules are mechanically coupled or uncoupled to connect or disconnect the respective links.

The diameter of the robot may be substantially constant across the passive joint modules. The diameter of the series of links and joint modules may be approximately equal. The diameter of the robot may be substantially constant along its length. For example, the diameter of the robot in the above cases may be constant apart from at the ends (which may be tapered for limited drag) and/or apart from the presence of one or more thrust devices or other protrusions such as a tool or other accessory. By maintaining the diameter in any of these ways, unwanted drag at narrowing/widening points of the robot can be reduced.

The robot may comprise one or more shrouds that ensure the diameter of the robot is substantially constant across the passive joint modules. The shrouds may each fit over at least part of a joint module, such as by forming a sleeve around a cable type joint module. Each shroud may be a flexible tube structure, such as a spiral tube, and each shroud may have approximately the same diameter as adjacent links of the robot. Each shroud may attach to joint modules and/or adjacent links of the robot.

Each shroud may be flooded with water when the robot is in use. For example, the shroud may have openings to allow water to enter into the shroud when the robot is submerged and drain from the robot when it is recovered from the water. This ensures the arrangement does not require sealing and prevents any possible sealing issues.

The passive joint modules may comprise buoyancy elements. These buoyancy elements may support the weight of the joint modules, preferably their entire weight. The buoyancy elements may be contained within a shroud as described above. The buoyancy elements may comprise a foam material, such as Hydraulic Crush Point (HCP) foam. One particular example is Divinycell HCP 70 foam which can withstand depths of up to 700 metres below sea level.

Foam materials such as this are lightweight and can withstand water pressure at depth in the ocean. The buoyancy elements may comprise other buoyancy material such as syntactic foam containing many tiny air-filled glass balls.

The passive joint modules may comprise instrumentation for measuring the angle of flexion of the joint module (i.e. the relative angle between adjacent links). Similar instrumentation may be provided in the links. It may be desirable to know such flexural angles to enhance the overall control of the robot.

The robot may comprise an accessory, or a connection point for an accessory, attached to the robot. The accessory may be any type of accessory required for submerged operations, including all types of underwater mapping, monitoring and IMR accessories, for example inspection accessories such as a camera or other sensor, or manipulator tools such as a gripper tool. The robot may effectively provide a manipulator arm without the encumbrance of an ROV or AUV holding the arm. The robot may be configured to manoeuvre itself to a target site, which can include travelling down pipes and through narrow spaces, carry out station keeping or hovering (also called dynamic positioning). The robot may be configured to use the accessory to perform a required operation, for example with the links of the robot acting as links of a manipulator arm.

The accessory or connection point may be attached at any convenient point on the robot and as noted above it may be any type of accessory, including an inspection accessory, manipulator tools, and other types of IMR accessories. Thus, the accessory or connection point may be at the front end of the robot, at a front module/link; it may be at a mid-point, integrated with one of the rigid links at a mid-length of the robot for example; or it may be at the stern end of the robot. There may be multiple accessories or connection points. Where a connection point is present there may be an accessory mounted to it in releasable fashion. Advantageously the connection point can be arranged for connection of alternative types of accessories, which can hence allow a single robot to be fitted with different accessories for different subsea operations.

In some preferred examples the robot has the accessory or the connection point for a tool at a front module, so that the accessory is located at the front end of the robot. An accessory mounted at the front end can have the greatest range of movement, especially when combined with a stern thrust device (and optionally also with thrust modules comprising one or more further thrust devices arranged for providing lateral thrust).

With the above in mind, it will be appreciated that one example embodiment of the snake robot may comprise a front module with the accessory or the connection point, a stern thrust device at the opposite end of the robot to the front module, multiple links between the front end and stern end, the links coupled by passive joint modules, and one or more thrust modules along the length of the robot for producing lateral thrust. Such a snake robot is capable of a large range of movements and can perform a wide range of differing types of subsea operations.

Thrust devices may be located at least at each end of the robot. This allows the entire series of links to be accurately and quickly controlled.

Thrust devices may be located along the entire body length of the robot, for example as a part of thrust modules that are incorporated with links of the robot. This allows the robot to be more responsive and allows it to attain more or less any body shape and posture. However, it will be appreciated that it is possible that one or more thrust devices may only be located at a front section of the robot, thus simplifying robot control during transit as all links behind this section will passively follow the front section of the robot, which is propelled by thrusters (similar to the lorry analogy described above).

The thrust device(s) may include a thrust device for applying lateral and/or vertical thrust, i.e. thrust in a direction extending across the length of the robot. The thrust device(s) may alternatively or additionally include a thrust device for applying longitudinal thrust, i.e. thrust in a direction extending along the length of the robot. The thrust device(s) may include propellers, impellers, tunnel thrusters, rotatable (azimuth) thrusters, screws (single, twin, contra rotating, controllable-pitch, nozzle style etc.), rudders, fins and/or water jets. Control surfaces like rudders and fins, guide vanes and/or the relative rotation between the links can be provided and may be used as thrust devices to passively or actively to contribute to direction control. This can be whilst the robot is being propelled by a separate thrust device, and also in the situation where the robot is being towed. The control surfaces may be part of the thrust device(s).

Thus, in some examples the robot includes one more steerable fin. Such fins or control surfaces may be used in order to avoid or suppress random disturbances from ocean currents, unmodelled cable buoyancy and so on. Other thrust device(s) may be used for the same purpose, instead of or in conjunction with the steerable fins.

The thrust device(s) may advantageously allow for the robot to keep a constant position and/or orientation in the water, in addition to controlling movement of the links and providing thrust for propulsion. Thus, the thrust device(s) may be arranged to provide thrust to give a hovering type capability to the robot.

An example of a thrust device for applying lateral thrust is a thrust module with one or more thrusters, the thrust module being integrated with a joint module or a link being mounted as an independent link fore or aft of a joint module.

Such a thrust module may, for example, include tunnel thrusters using propellers, or water jet thrusters. A preferred example uses a thrust module with thrusters oriented in two perpendicular directions, which may be two directions that are generally orthogonal to the longitudinal extent of the robot (or a tangent to the extent of the robot when it is in a curved shape). This allows thrust to be applied in any lateral direction, such as an up-and-down direction, or a side-ways direction. There may be multiple thrust modules along the length of the robot. This allows thrust to be applied to different parts of the robot in different directions, which means that all kinds of movements can be achieved, such as a translation movement of the robot, or a rotation without translation, or combinations of the two.

An example of a thrust device that may be employed for applying longitudinal thrust is a stern thrust device mounted at the stern of the robot for applying a thrust at the end of the robot. Longitudinal thrust devices could of course be mounted at a mid-point of the robot or at the front of the robot, but it is considered that a stern mounted device is most useful and also this enables the thruster to be in-line with the length of the robot, rather than resulting in a protrusion from the robot at one side, which might otherwise be required to allow thrust in a longitudinal direction. The thruster for applying longitudinal thrust can be any suitable thruster, such as a propeller or a water jet thruster, for example.

The robot may comprise a thrust module at each end. This may enable the entire series of links to be controlled via thrust from each end of the robot. Each thrust module may be able to provide multiple thrust directions as described above so that they can apply a rotation force/moment as well as forces along the robot length or perpendicular to the robot length. It will be appreciated that with such thrust modules at each end, then even with passive joints it is still possible for the robot to change between many configurations. For example, switching between a C shape, an S shape and other shapes by simply providing a suitable twisting force at each end via the thrust modules.

A thrust device capable of providing lateral thrust may be used to adjust the vertical position of the robot and/or its orientation in a vertical plane by applying thrust away from the centre-of-mass of the robot. However, in the likely event that the robot is not perfectly neutrally buoyant, then continual thrust will be required in order to maintain a constant vertical position and/or orientation. This can be a disadvantage in relation to power usage and thus it is desirable to avoid this, especially where the robot is battery powered. To address this issue, the robot may optionally be provided with elements having controllable buoyancy. For example, the robot may include ballast tanks that can be filled with pressurised air or alternatively any "bladder" or fluid that can be compressed or expanded to change its buoyancy or weight. An element with controllable buoyancy can provide the forces necessary to maintain a constant vertical position without requiring energy consumption except during inflation or deflation. These may include the buoyancy elements mentioned above.

A preferred implementation may include both one or more thrust devices for vertical thrust and also one or more elements with controllable buoyancy. The thrust device(s) and controlled-buoyancy elements may be incorporated in a single module, such that a thrust module as described above may also have a controlled-buoyancy capability. Advantageously, the buoyancy or weight can be used to provide a slowly varying vertical force to compensate for the weight of the robot and/or for constant vertical currents, whereas the thrust device(s) can provide a rapid corrective force to compensate for rapid changes in forces affecting the robot, for example sudden shifts in currents, or changes arising from changes in shape of the robot. This arrangement can make effective use of the more energy efficient buoyancy elements, whilst also allowing accurate and rapid control of the robot's position and orientation. In one preferred example the buoyancy of the controllable-buoyancy elements may be controlled locally as the time integral (i.e. an integral controller) of the vertical component of the local thruster control inputs, so that the average vertical thrust converges to zero under stationary conditions. Thus, the high-frequency vertical forces are provided by thrusters, while the low-frequency component is provided by the buoyancy elements The robot may include a gait pattern controller for generating the motion of the robot and the resultant motion of each of the links. The robot may include an orientation control device for adjusting the orientation to the desired orientation. Thus could for example be a heading control device for adjusting the heading to follow the desired orientation. This device would hence provide adjustments in the yaw direction. The robot may alternatively or additionally include a pitch control device for allowing ascent and descent during the forward movement. The heading and/or pitch control devices may act during undulating motion, during thrust driven motion, or with both undulations and thrusters exciting motion of the robot. The heading and/or pitch control devices may be able to control the thrusters, in particular the thrust modules, in order to thereby control heading and/or pitch during forward motion.

The robot may have an accessory controller for controlling the accessory, such as for activating the accessory or controlling its motion. This may hence be a controller for controlling the orientation and location of the part of the robot where the accessory is mounted, for example the front module.

The various controllers may be separate control modules formed as separate hardware, or separate software in common hardware, or there may be an integrated system which handles all aspects of control of the robot.

The present invention also provides a method for control of an underwater snake robot according to the first aspect, including any of the optional features described herein, the method comprising: controlling the thrust device(s) in order to move the robot into a required orientation and location; wherein the one or more thrust devices are used to generate thrust for propulsion and a flexural motion in the passive joint modules in order to adjust the shape and configuration of the robot.

The thrust for propulsion and the flexural motion in the passive joint modules in order to adjust the shape and configuration of the robot may come entirely from the thrust device(s).

The method may comprise adjusting the shape of the robot into a linear configuration for reduced drag parallel to its axis; and applying thrust along the length of the robot parallel to its axis using the thrust device(s) in order to move the entire robot in translation. Such a method provides an efficient manner for the robot to move travel long distances as the overall drag is reduced.

The method may comprise controlling the robot and thrust device(s) to produce any of the effects described above.

The method may comprise determining the orientation and/or angle of flexion of the joint modules.

The method may comprise determining the orientation of all of the joint modules and thrust device(s), determining a vector for thrust from each thrust device, and thereby determining required thrust forces and/or joint module adjustments to achieve a required change in orientation and/or location of the robot and/or its tool(s).

The present invention also provides a computer programme product comprising instructions that when executed on a data processing device will configure the data processing device to control an underwater snake robot according to the first aspect by means of a method as described above, including any or all of the optional features.

According to a second aspect, the present invention provides an underwater snake robot for performing subsea operations, the robot comprising: a series of links that are connected to one another by one or more joint modules for allowing a flexural motion of the robot; and one or more thrust device(s) for applying thrust to the robot for propulsion and/or guidance; wherein the flexural motion and/or thrust device(s) enable movement of the robot and control of the orientation and/or location of the links, and wherein the robot has a length to diameter ratio of at least 25:1.

The endurance of an underwater robot during subsea operations is primarily affected by two factors: a) the available battery power on board the robot and b) the power the robot consumes when travelling and performing operations such as those with the accessories described above.

Factor a) can be improved by adding more batteries into the robot. However, doing so necessarily results in the robot being larger. Larger robots produce more drag and thus this negatively impacts factor b) by increasing power consumption in moving the robot. In order to provide the necessary additional space for added battery power but reduce the impact this has on the power requirements of the robot, the robot according to the second aspect utilizes a length to diameter ratio of at least 25:1 in order to reduce the relative drag forces during transit by reducing the robot diameter, thus making it more streamlined.

The robot according to the second aspect therefore provides a more efficient robot with greater operational capabilities and range.

This is particularly advantageous in the subsea oil & gas industry where autonomous underwater vehicles (AUVs) are used to inspect and monitor the state of pipelines on the seabed. The operation requires that the robot carries out transit along and a few meters above a long distance of pipeline while collecting various types of sensor data relevant to the state of the pipe.

The power endurance of the vehicle is a key parameter that greatly affects the efficiency of such pipe inspection operations in terms of time and cost. When the vehicle is low on battery power, it must typically be recovered by a surface vessel to charge or replace the batteries. Such surface vessels have very high day rates, which account for a large part of the operation cost. Increasing the length of pipeline which the vehicle can inspect in a single run will in other words reduce the duration and cost of the operation.

It will be appreciated that length of a conventional AUV with a rigid and stiff hull has a practical limit since vehicle handling on shore/boat will at some point become too challenging. For this reason, conventional AUVs typically have a length to diameter ratio well below 25. This practical constraint on the length of conventional AUVs places a constraint on their battery storage capacity and power endurance as discussed above.

In comparison, the underwater snake robot according to the second aspect far exceeds the operational capabilities and range of such conventional vehicles, as well as potentially being more easily handled, as discussed in more detail below.

It will be appreciated that any of the above described features of the first aspect of the invention and/or optional features of the robot according to the first aspect of the invention may be incorporated into the underwater robot of the second aspect, and vice versa. There are particular synergies from the use of passive joint modules, as in the first aspect, with the length to diameter ratio of the second aspect, since for longer robots the number of links and joint modules will increase and the benefit of the simpler form of a passive joint module is magnified.

In the present discussion references to the diameter of the robot may be taken to refer to a circular diameter within which the cross-section of the robot may fit, or effectively a hole through which the robot may pass. Whilst it may be advantageous for some parts of the robot to have a circular cross-section and/or a generally cylindrical form it will be appreciated that other cross-sectional shapes may be used and there may be recesses or protrusions as a part of the robot's design. The robot may have a length to diameter ratio of at least 30:1, preferably at least 50:1 and more preferably at least 100:1. In one example, the robot has a length to diameter ratio of around 150:1.

The robot may have a length of at least 10 m, preferably at least 15 m and more preferably at least 20 m. In one example, the robot has a length of 30 m.

The cross-section of the robot, links of the robot and/or thrust device(s) may fit within a diameter of less than 1 m, preferably less than 75 cm, and more preferably less than 50 cm. In one example, the cross-section of the robot fits within a diameter of approximately 20 cm.

The robot may comprise at least 10 links and optionally at least 20, 30 or more links, and each may have a suitable length to diameter ratio.

The robot may comprise multiple thrust devices. Such multiple thrust devices may be positioned along the length of the robot for generating flexural motion of the robot, and/or controlling the orientation/location of the links.

The robot may comprise an accessory, or a connection point for an accessory, attached to the robot. This may be any of the accessories of connection points previously described.

The robot may comprise multiple accessories, or connection points for accessories, attached to the robot at different points along the length of the robot. By utilising a robot with a long length to diameter ratio and multiple accessories, or connection points for accessories, multiple operations can be performed simultaneously. For example, multiple sections of pipelines can be inspected at once, thus increasing the efficiency of the operations of the robot. Increasing the length of pipeline which the robot can inspect in a single run will reduce the duration and cost of the operation.

The robot may comprise at least one battery module. The at least one battery module may form or be part of a link. The robot may comprise multiple battery modules. Each battery module may form or be part of a link. The battery modules may be located at different points along the length of the robot.

The robot may comprise at least two battery modules, preferably at least three battery modules and more preferably at least five battery modules. The number of battery modules may be configured to provide the necessary power to meet the requirements of particular robot/operation.

The battery modules(s) may be interchangeable so that it/they can be replaced with another battery module when necessary. For example, when more power is required/desired and/or to allow offline charging of battery modules. Such offline charging allows for a quick 'refuel' from the fitting a fully charged module to replace a depleted battery module in the robot whilst the depleted battery module can be recharged separately. This may be performed very quickly with the cable connections and/or modular arrangement described above in relation to the first aspect. Furthermore, this may be performed subsea without the need to recover the robot.

The diameter of the robot may be substantially constant across the passive joint modules. The diameter of the series of links and joint modules may be approximately equal. The diameter of the robot may be substantially constant along its length. For example, the diameter of the robot in the above cases may be substantially constant apart from at the ends (which may be tapered for limited drag) and/or apart from the presence of thrust device(s) or other protrusions such as tools. By maintaining the diameter in any of these ways, unwanted drag at narrowing/widening points of the robot can be reduced. This may be achieved using the shrouds described above in relation to the first aspect.

The robot may comprise a connector for connecting one end of the robot to a winch system. Such a connector may be configured so that a winch system can be used to store, launch and/or recover the robot.

The connector may comprise a rope, line or tether that is configured to float when it is released from the robot. Recovery could then be achieved using the connector. For example, by enabling a tail section of the robot to release a floating rope on the surface, which is picked up from the water by personnel on a boat and connected to a winch in order to start reeling in the robot (as described in more detail below).

Alternatively, or in addition to the passive joint modules described above in relation to the first aspect, the robot according to the second aspect may comprise active joints. The flexural motion of the robot may therefore be generated by active joints and/or the thrust device(s). Thus, the joint modules may actively drive movement of the links relative to one another and may be actuated by one or more actuators or motors; for example electric, pneumatic, and/or hydraulic actuators. The actuators or motors may be contained within the links or held in between the links. In some preferred examples, the flexural motion of the robot can be an undulating motion capable of propelling the robot.

The present invention also provides a method for control of an underwater snake robot according to the second aspect, including any of the optional features described herein, the method comprising: controlling the thrust device(s) and/or the joint modules in order to move the robot into a required orientation and/or location; wherein the thrust device(s) and/or the joint modules are used to generate a flexural motion and adjust the shape and configuration of the robot; and wherein the thrust device(s) are used to move all of or parts of the robot in translation and/or in rotation.

The method may comprise adjusting the shape of the robot into a linear configuration for reduced drag parallel to its axis; and applying thrust along the length of the robot parallel to its axis using the thrust device(s) in order to move the entire robot in translation. Such a method provides an efficient manner for the robot to move travel long distances as the overall drag is reduced. This is particularly suitable for inspecting long distance pipelines as discussed above.

The method may comprise controlling of the thrust device(s) and/or joint modules to produce any of the effects described above.

The method may comprise using the joint modules to adjust the robot configuration and using the thrust device(s) to translate and/or rotate the robot, to move the robot and/or its tool(s) to a required location and/or orientation.

The method may comprise determining the orientation of all of the joint modules and thrust device(s), determining a vector for thrust from each thrust device, and thereby determining required thrust forces and/or joint module adjustments to achieve a required change in orientation and/or location of the robot and/or its tool(s).

The present invention also provides a computer programme product comprising instructions that when executed on a data processing device will configure the data processing device to control an underwater snake robot according to the second aspect by means of a method as described above, including any or all of the optional features.

According to a third aspect, the present invention provides an underwater robot system comprising: an underwater snake robot comprising a series of links that are connected to one another by one or more joint modules for allowing a flexural motion of the robot, optionally being the underwater snake robot of the first or second aspect; and a winch system, the winch system comprising: a rotatable drum; a mechanism for connecting one end of the snake robot to the rotatable drum; and a drum driver for rotating the drum wherein the robot is coiled around the rotatable drum when in a stored configuration.

As mentioned above, the possible length of a conventional AUV with a rigid and stiff hull has a practical limit since vehicle handling on shore/boat will at some point become too challenging. For this reason, conventional AUVs typically have a length to diameter ratio well below 25, which places a constraint on their battery storage capacity and endurance. However, by utilizing a system according to the third aspect, it is possible to handle flexible underwater snake robots with extreme length, by making use of their flexible body. As such, these robots can be utilized easily and effectively, avoiding the constraints placed on battery power by robot size due to handling concerns. It will be appreciated that the system according to the third aspect combines well with the use of more elongate robots, as in the second aspect, and also may be particular advantageous when the robot comprises passive joint modules, as in the first aspect. The features discussed above for the first and second aspects may be combined with the robot system of the third aspect, and vice versa. In some examples the robot may hence comprise flexible couplings between adjacent links without any fixed pivot point. For example, flexible cable couplings, such as the durable subsea cables as previously discussed. Such joint modules are well suited to allowing the robot to be coiled around the rotatable drum.

The system according to the third aspect therefore provides an easier way of storing, launching and recovering an underwater snake robot, especially one of increased length compared to prior art robots.

By the reference to the robot being coiled around the rotatable drum in the stored configuration it is meant that the robot is looped around the outer surface of the drum at least once.

In the stored configuration the robot may span multiple turns around the drum and this may be in a single or multiple layers on top of one another.

The rotatable drum may be controllably rotated both clockwise and counter-clockwise by the drum driver. The drum driver may be powered, for example via the engine of a ship. Alternatively or additionally the drum driver may be driven by hand.

The system may be located on the deck of a vessel, on an offshore platform or onshore.

The rotatable drum does not necessarily need to be cylindrical. It will be appreciated that since the robot will have a series of links of some length interconnected by joint modules (that may be flexible couplings as previously discussed), a cylindrical shape may not be an optimal solution. Instead, the drum may be a box-like shape or some other multi-sided shape depending on the robot configuration and length of the links. The general idea of the third aspect is to provide a system that makes it possible to winch the robot onto the drum by rotating the drum and thereby reeling in the robot; it will be appreciated that the drum may therefore have any shape appropriate to the configuration of the robot.

The present invention also provides a method of storing, launching and/or recovering an underwater snake robot comprising a series of links that are connected to one another by joint modules for allowing a flexural motion of the robot, the method comprising: connecting or disconnecting one end of the robot to a rotatable drum; and rotating the rotatable drum. The robot may be as described above in relation to the first and/or second aspect, or optional features thereof. The method may use the system of the third aspect, or optional features thereof.

The connecting and disconnecting of the robot may be performed using the connector of the robot previously described, such as the floating rope. The robot may therefore comprise a connector including a floating rope at one end of the robot and the method may comprise releasing the floating rope from the robot and connecting the floating rope to the rotatable drum. The mechanism for connecting one end of the robot to the rotatable drum may comprise a winching rope. The floating rope may be connected to the rotatable drum via the winching rope during recovery. The winching rope may be cast into the water to grab hold of the robot in some way (e.g. via a hook/grab mechanism at the end of the winching rope). The robot may then be recovered by winching in the floating rope and the robot via the winching rope.

The rotating of the drum may be for the any or all of the following purposes: launching the robot; storing the robot; towing the robot; recovering the robot; and/or reeling in the robot.

The rotating of the rotatable drum may winch or unwinch the robot along its length such that a force generated between the drum and robot is parallel to the axis of the robot.

The rotating of the rotatable drum may be controlled to unwinch the robot into water from a stored configuration in which the robot is coiled around the rotatable drum. This allows for a controlled rate of launch into the water, reducing the chance of damaging the robot on launching.

The method may comprise connecting one end of the snake robot to the rotatable drum when the robot is in water and the rotating of the rotatable drum may then winch the robot out of the water into a stored configuration in which the robot is coiled around the drum. This allows for a controlled rate of recovery, reducing the chance of damaging the robot during recovery. For example, by allowing time for parts of the robot (e.g. the shrouds previously described) to drain of water.

Figure 1B:
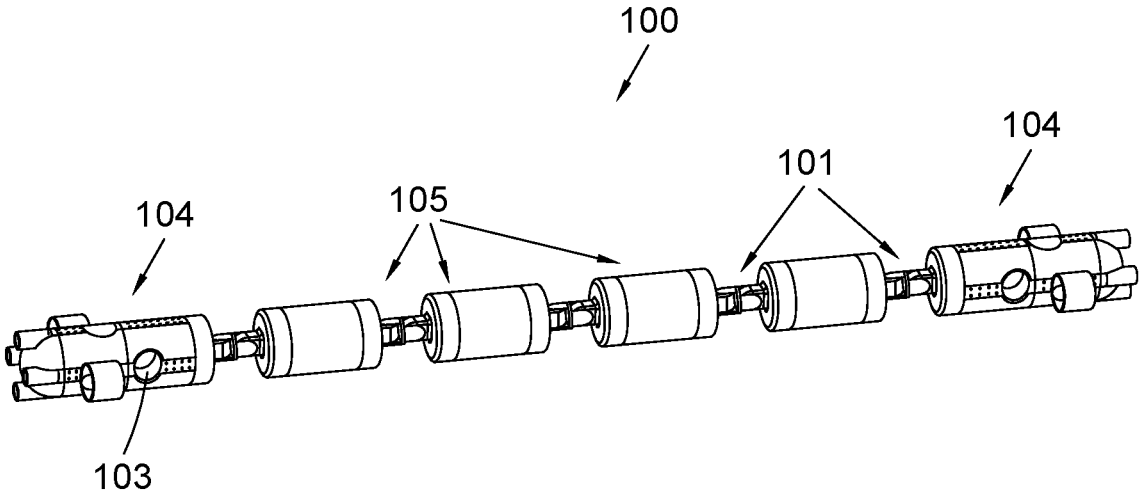
Figure 2A:
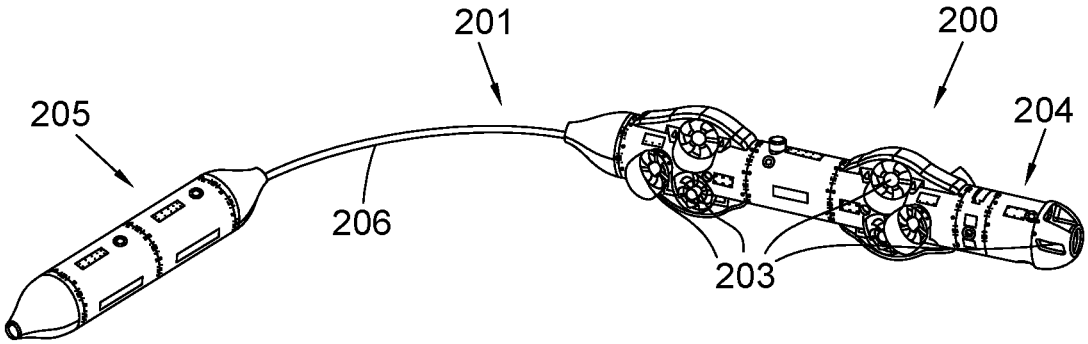
Figure 2B:
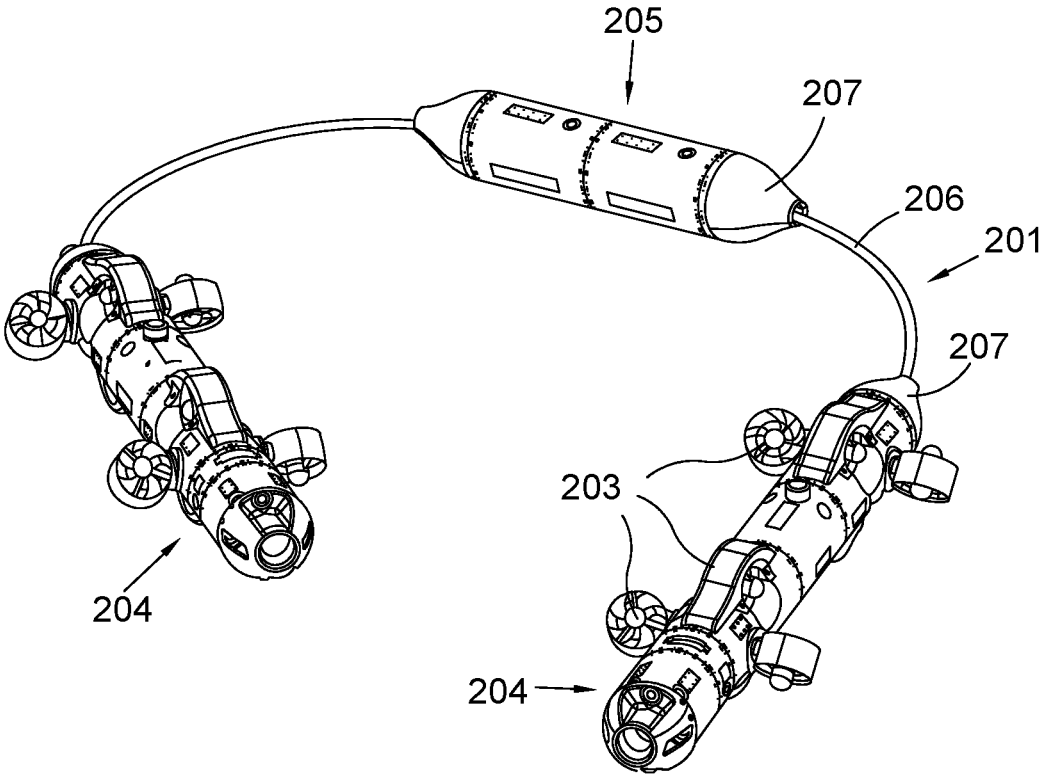
Figure 3A:
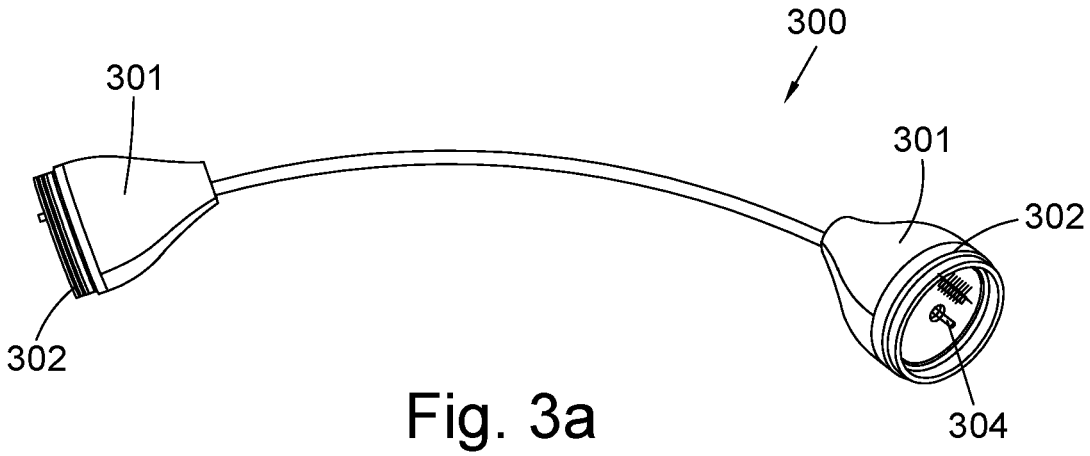

Certain preferred embodiments of the invention will now be described by way of example only and with reference to the accompanying drawings in which:

FIGS. 1*a* and 1*b* show isometric views of a snake robot with passive joint modules and thrust devices, wherein the passive joint modules each comprise articulated mechanical joints;

FIGS. 2*a* and 2*b* show isometric views of other snake robots with passive joint modules and thrust devices, wherein the passive joint modules each comprise a cable connection;

FIG. 3*a* shows a closer view of a cable connection of the passive joint modules shown in FIGS. 2*a* and 2*b;*

Figure 3B:
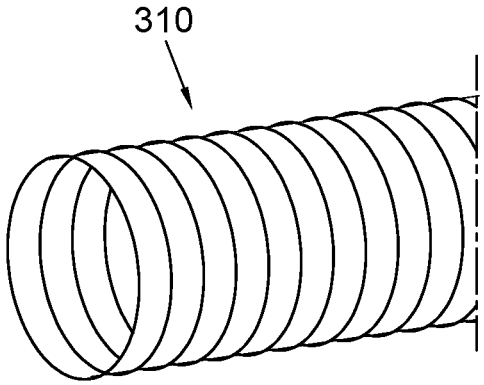
Figure 4:
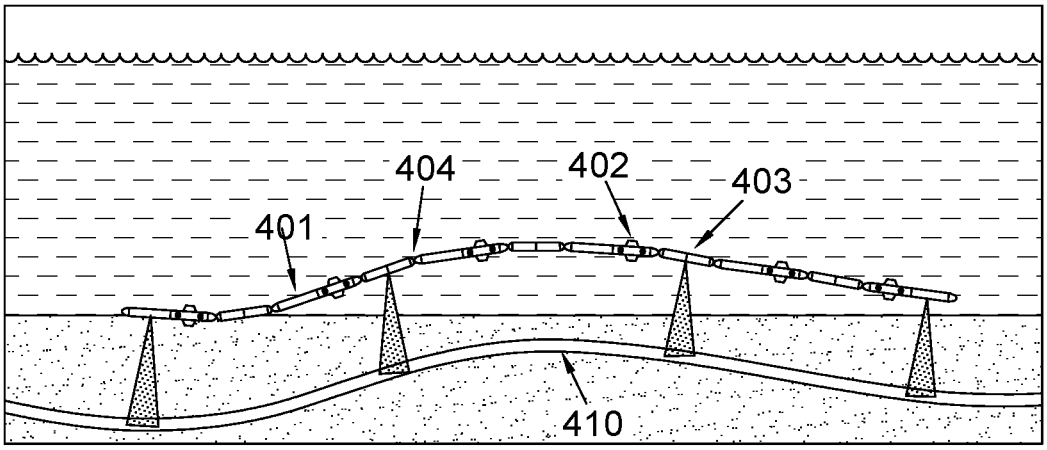
Figure 5:
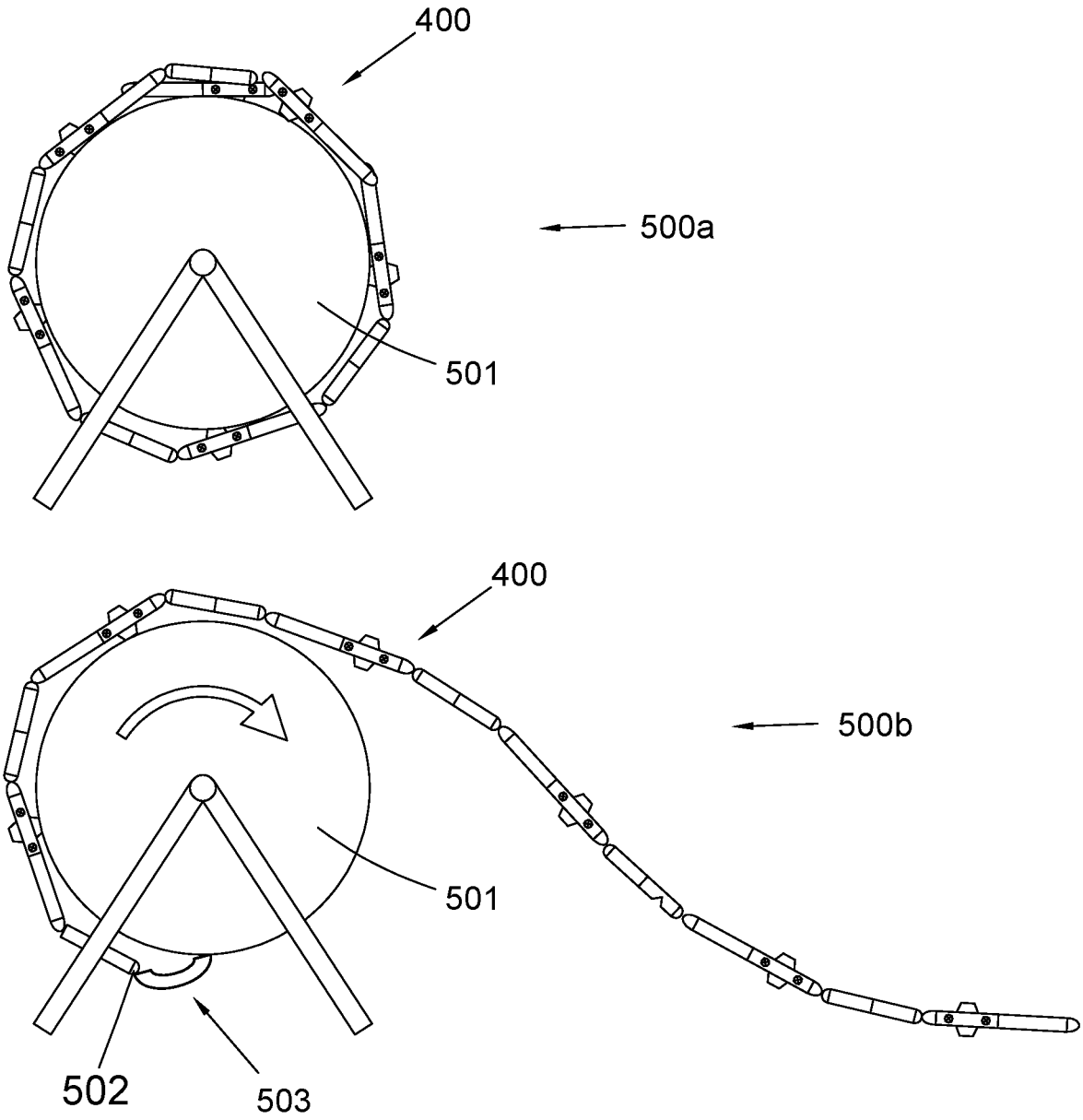

FIG. 3*b* shows a shroud for fitting over the passive joint modules of a robot;

FIG. 4 shows a swimming underwater snake robot with a large length to diameter ratio, comprising a number of battery modules, thrust devices and sensors/accessories along its length; and FIG. 5 shows an underwater robot system, the system comprising a winch system for storing, launching and/or recovering an underwater snake robot.

With reference to FIGS. 1*a* and 1*b* a snake robot 100 for performing subsea operations is shown. The robot 100 comprises a number of passive joint modules 101 connecting a series of six links 102. The passive joint modules allow flexural motion of the robot 100.

The robot 100 also comprises thrust devices 103 that are part of thruster modules 104 and the thruster modules 104 are positioned in the series of links 102 at each end of the robot.

The thrust devices 103 take the form of tunnel thrusters in the body of the thruster module and propellers extending from the exterior that can change the direction of thrust applied by rotation to change the orientation of the propeller relative to the robot. Together, the thrust devices 103 of each thruster module can apply thrust in any desired direction to provide the required movement and orientation of the robot 100. It will be appreciated that other forms of thrust devices could be used as well as additional thrust devices/thruster modules positioned in other links.

In this particular robot, the series of links 102 comprises two thruster modules 104, one at each end, and four battery modules 105 located between to supply power for the operations of the robot. Where it is required to have a robot with increased length and a length to diameter ratio as discussed below then the number of modules may be increased, such as by adding further battery modules.

Optionally, the thruster modules 104 at each end of the robot also comprise a number of cameras (not shown) for performing subsea inspection operations and are also arranged for attachment of one or more tools (not shown). It will be appreciated that different types of tools may be provided on the robot 100 for different operations. For example, there may be a manipulation tool.

The passive joint modules 101 comprise articulated mechanical joints that allow flexural motion with at least two degrees of freedom between adjacent links 102. It will be appreciated that passive joint modules with further degrees of freedom may be provided, for example the cable coupling shown in FIG. 3*a*.

Flexural motion of the robot 100, its orientation and location are all controlled with thrust from the thrust devices 103. The thrust devices 103 can apply propulsion of the entire robot in translation, can alter the angle of flexion between links and can rotate links. The passive joint modules 101 respond to external forces (such as the forces from the thrust devices 103) to change their shape and/or angle of flexion and do not have (or need) the ability to control their own shape and angle, or generate any appreciable motive force themselves. The shape and/or angle of flexion of the joint modules is therefore controllably altered under the influence of thrust from the thrust devices 103. The motion of the passive joint modules 101 in response to the thrust devices 103 of the thruster modules 104 located at the ends of the robot is therefore analogous to a lorry truck or land train with multiple carriages, where the carriages passively follow the steering of the truck in the front.

By utilising passive joint modules 101 and generating the flexural motion of the robot/controlling the orientation and location of the links with thrust devices 103, the design of the robot is simplified. This reduced complexity in turn reduces the chances of failure of the joint modules 101 and reduces the amount of maintenance required. The robot 100 is therefore simple and robust; cheaper to produce and maintain compared to active joint systems; and lighter in weight (and thus easier to lift and handle) compared to heavier, active motorized systems.

With reference to FIG. 2*a* another snake robot 200 for performing subsea operations is shown. This robot 200 is similar to the robot 100 described above and like features perform similarly to the manner already described.

The robot 200 comprises a single passive joint module 201 connecting a series of two links. The passive joint module 201 allows flexural motion of the robot 100.

In this robot 200 there is only one thruster module 204 in the series of two links, located at the front of the robot. The thruster module comprises multiple thrust devices 203. Similar to the robot 100 described above, the thrust devices 203 are tunnel thrusters. This robot also includes a stern thrust device, i.e. a thrust device mounted at the stern, which may conveniently be used for forward propulsion of the robot when it is in a straight configuration. As with the robot described above, it will be appreciated that where it is required to have a robot with increased length and a length to diameter ratio as discussed below then the number of modules may be increased.

In this robot 200 the passive joint module comprises a cable coupling in the form of a durable subsea cable 206 between adjacent links 202 of the robot with no fixed pivot point. This cable coupling allows for yawing, pitching and rolling of adjacent links 202 relative to one another as well as some limited translational movement.

At each end of the cable coupling 206 is a connector interface 207 for connecting to a link 202 of the robot and this allows for individual links 202 and joint modules 201 of the robot to be disconnected and replaced when necessary. For example, if the battery module 205 is low in power it may be replaced with a fully charged battery module 205 when more power is required by the robot. This avoids the need for charging time and hence maximises the time that the robot is available for use.

Cable couplings 206 and connection interfaces 207 such as this also allow for a modular arrangement of the robot so that other configurations of robot can be formed, for example as shown in FIG. 2*b* where two thruster modules 204 have been connected to a single battery module 202 via flexible couplings 201 to provide a robot with improved agility and range of operations. It will be appreciated that in a similar manner other series of links may be formed, for example a longer robot with greater capacity for batteries as shown in FIG. 4 and described in more detail below.

FIG. 3*a* shows an individual cable coupling 300 similar to that described above. Connector interfaces 301 at each end of the cable coupling 300 comprise a screw thread arrangement 302 for connecting to links of a robot and a signal bus 304 for carrying power and communication signals between links. Instrumentation for measuring the angle of flexion of the joint module can be incorporated into the cable coupling 300.

FIG. 3*b* shows a shroud 310 that can be fitted over a passive joint module such as the cable coupling 300 shown in FIG. 3*a* in order to ensure the diameter of the robot is substantially constant along its length and across the passive joint modules, as the diameter of the shroud can be matched to that of the links. The shroud 310 is a flexible tube structure so that is does not restrict the movement of the passive joint modules.

The shroud 310 is open at each end and may comprise holes to ensure the interior of the shroud is flooded with water when the robot is in use (and to ensure it drains when the robot is lifted from the water).

Buoyancy elements (not shown) are also selected and placed inside of the shrouds in order to optimise the buoyancy of the robot.

FIG. 4 shows an underwater snake robot 400 with a large length to diameter ratio, comprising a series of links made up of a number of battery modules 401 and thruster modules 402 along its length, the series of links being connected by passive joint modules 404. The battery modules 401, thruster modules 402, and passive joint modules 404 operate in manner similar to that previously described. The flexural motion, orientation and location of the robot are controlled with thrust devices of the thruster modules 502 as previously described.

The snake robot 400 is shown performing inspection operations on a subsea pipeline 410. This is performed using a number of sensors/accessories 403 in the form of cameras and lights along the length of robot. Tools or connection points may also be similarly dispersed along the length of the robot.

By having a large length to diameter ratio, relative drag forces on the robot 400 in use are reduced as a result of a smaller diameter/cross-section, thus making the robot 400 more streamlined without compromising operational capabilities as the long length ensures there is still enough space for the necessary battery modules 401 and sensors/accessories 403 for a particular operation and a required battery life. The robot 400 is therefore a more efficient robot with greater operational capabilities and range.

This particular robot comprises three battery modules 401 located at different points along its length and has a length to diameter ratio of at least 25:1, with a length of around 25 m. It will be appreciated that any particular number of battery modules 401, thruster modules 402, passive joint modules 404 and sensors/accessories 403 may be provided depending on a particular application. The number of these components, and the length of the robot can be modified in the modular fashion previously described. This also allows the various components to be interchangeable and the optimal length to diameter ration to be attained.

The storage, launch and recovery of the robot will now be described relation to FIG. 5.

FIG. 5 shows a first, stored arrangement 500*a* of the snake robot 400 and a second arrangement of the snake robot 500*b* where it is in the process of being launched from the stored position 500*a*.

In the stored arrangement 500*a* the snake robot 400 is coiled around a rotatable drum 501 of a winch system. The winch system can be fitted to a ship or platform, or can be located onshore. The robot 400 is connect to the rotatable drum 501 at one end. The drum 501 is wide enough so that the robot 400 can be coiled around the drum 501 in multiple turns but in a single layer to reduce the chance of damage to the robot by wearing against itself.

To launch the robot 400 as shown in arrangement 500*b*, the rotatable drum 501 can be controllably rotated in the direction indicated by the arrow to unwind the robot 400. The drum 501 may be driven by a user turning a handle or it may be driven via a motor, such as an electrical motor. When the robot 400 has been fully unwound from the drum 501 (the robot 400 typically being partially in the water by this point and so supporting its own weight) the remaining connecting end 502 can be disconnect from the drum 501, thus releasing the robot 400.

It will be appreciated that a similar operation can be performed in reverse to recover and store the robot 400, by connecting one end 502 of the robot to the drum 501 and rotating the drum in the opposite direction to winch the robot out of the water and into the stored configuration 500*a*.

To aid in this recovery the robot 400 comprises a connector 503 for connecting to the drum 501. The connector 503 is stored inside of the front or rear link of the robot 400 in use (i.e. when operating in water) and includes a floating rope that can be released when recovery is desired, grabbed by an operator and connected to the drum 501.

By utilizing a winch system such as this, it is possible to handle flexible underwater snake robots with extreme length, such as robot 400, by making use of their flexible body. As such, these robots can be utilized easily and effectively.

The invention claimed is:

1. An underwater robot for performing subsea operations, the robot comprising:

a series of links that are connected to one another by one or more passive joint modules for allowing a flexural motion of the robot; and one or more thrust devices for applying thrust to the robot for propulsion, for generating the flexural motion of the robot and for controlling the orientation and location of the links;

wherein the cross-section of the robot, links of the robot and/or thrust device(s) of the robot fit within a diameter of less than 1 metre.

2. An underwater robot as claimed in claim 1, wherein the passive joint modules each comprise a flexural coupling with at least two degrees of freedom between adjacent links.

3. An underwater robot as claimed in claim 1, wherein the passive joint modules each comprise articulated mechanical joints.

4. An underwater robot as claimed in claim 1, wherein the passive joint modules are each couplings between adjacent links without any fixed pivot point.

5. An underwater robot as claimed in claim 1, wherein the passive joint modules each comprise a cable connection.

6. An underwater robot as claimed in claim 1, wherein the passive joint modules each comprise a connector interface at each end which connects to adjacent links of the robot and allows for individual links and/or joint modules of the robot to be replaced when necessary.

7. An underwater robot as claimed in claim 6, wherein the links and passive joint modules are modular.

8. An underwater robot as claimed in claim 1, wherein the robot comprises at least one battery module.

9. An underwater robot as claimed in claim 1, wherein the passive joint modules comprise a signal bus for enabling power transfer and/or communication between links.

10. An underwater robot as claimed in claim 1, wherein thrust devices are located at least at each end of the robot.

11. An underwater robot as claimed in claim 10, wherein further thrust devices are located at positions along the length of the robot between the ends of the robot.

12. An underwater robot as claimed in claim 1, wherein the diameter of the robot is substantially constant across the passive joint modules.

13. An underwater robot as claimed in claim 12, wherein the robot comprises one or more shrouds that ensure the diameter of the robot is substantially constant across the passive joint modules.

14. An underwater robot as claimed in claim 13, wherein at least one of:

each shroud is a flexible tube structure with the same diameter as the links of the robot; or wherein each shroud is flooded with water when the robot is in use.

15. An underwater robot as claimed in claim 1, wherein the passive joint modules comprise buoyancy elements.

16. An underwater robot as claimed in claim 1, wherein the passive joint modules and/or links comprise instrumentation for measuring the angle of flexion of the joint module.

17. A method for control of an underwater robot as claimed in claim 1, the method comprising: controlling the thrust device(s) in order to move the robot into a required orientation and location; wherein the one or more thrust devices are used to generate thrust for propulsion and a flexural motion in the passive joint modules in order to adjust the shape and configuration of the robot.

18. A method for control of an underwater robot as claimed claim 17, wherein the thrust for propulsion and the flexural motion in the passive joint modules in order to adjust the shape and configuration of the robot comes entirely from the thrust device(s).

19. A computer programme product comprising instructions that when executed on a data processing device will configure the data processing device to control an underwater robot claimed in claim 1 by means of a method comprising: controlling the thrust device(s) in order to move the robot into a required orientation and location; wherein the one or more thrust devices are used to generate thrust for propulsion and a flexural motion in the passive joint modules in order to adjust the shape and configuration of the robot.

20. An underwater robot as claimed in claim 1, wherein the passive joint modules only respond to external forces to change their shape and/or angle of flexion.

* * * * *